US010605535B2

(12) United States Patent
Bini et al.

(10) Patent No.: US 10,605,535 B2
(45) Date of Patent: Mar. 31, 2020

(54) HEAT EXCHANGER FOR CONTAMINATED FLUIDS AND SUBJECTED TO STRONG VARIABLE HEAT LOAD

(71) Applicant: TURBODEN S.R.L., Brescia (IT)

(72) Inventors: Roberto Bini, Brescia (IT); Mario Gaia, Brescia (IT)

(73) Assignee: TURBODEN S.R.L., Brescia (IT)

( * ) Notice: Subject to any disclaimer, the term of this patent is extended or adjusted under 35 U.S.C. 154(b) by 407 days.

(21) Appl. No.: 15/302,935

(22) PCT Filed: Apr. 9, 2015

(86) PCT No.: PCT/IB2015/052601

§ 371 (c)(1),
(2) Date: Oct. 7, 2016

(87) PCT Pub. No.: WO2015/173673

PCT Pub. Date: Nov. 19, 2015

(65) Prior Publication Data

US 2017/0030653 A1 Feb. 2, 2017

(30) Foreign Application Priority Data

May 14, 2014 (IT) ..... BS2014A0094

(51) Int. Cl.
*F28D 7/10* (2006.01)
*F28F 9/02* (2006.01)
(Continued)

(52) U.S. Cl.
CPC ..... *F28D 7/106* (2013.01); *F28F 9/0236* (2013.01); *F28F 9/0263* (2013.01); *F28F 9/18* (2013.01);
(Continued)

(58) Field of Classification Search
CPC ..... F28F 9/0236; F28F 2265/26; F28F 9/18; F28F 2240/00; F28D 7/106
See application file for complete search history.

(56) References Cited

U.S. PATENT DOCUMENTS 3,144,080 A * 8/1964 Vollhardt ..... F28D 7/106 165/159
3,494,414 A * 2/1970 Warner ..... F28F 9/0241 165/158
(Continued)

FOREIGN PATENT DOCUMENTS

DE 2509897 A1 * 9/1976 ..... B01D 45/12

OTHER PUBLICATIONS

DE-2509897-A1 machine translation (Year: 1976).*

*Primary Examiner* — Gordon A Jones
(74) *Attorney, Agent, or Firm* — R. Ruschena Patent Agent, LLC

(57) ABSTRACT

Heat exchanger (100, 200) for cooling contaminated fluids and which are subjected to variable thermal load, by means of heat transfer to a receiving liquid and/or vapor fluid, said heat exchanger comprising a tube bundle consisting of a plurality of independent tubes (1), two plenums (9, 10, 109, 110), plates (12, 13, 112, 113), and characterized in that said independent tubes (1) comprise an inner tube (2, 102) in which the contaminated gas flows, and an outer tube (3, 103) being said inner tube (2, 102) and outer tube (3, 103) coaxial and where between the outer surface (2', 102') of the inner tube (2, 102) and the inner surface (31, 103') of the outer tube (3, 103) is defined an annular passage G in which flows the receiving fluid and in that said inner tube (2, 102) is welded to the plate (12, 112) in a gas inlet section, while a gas outlet section is guided in a corresponding hole of the
(Continued)

plate (13, 113), so that the inner tube (2, 102) expansion in an axial direction is not constrained.

11 Claims, 3 Drawing Sheets

(51) Int. Cl.
*F28F 13/12* (2006.01)
*F28F 9/18* (2006.01)

(52) U.S. Cl.
CPC ..... *F28F 13/12* (2013.01); *F28F 2009/029* (2013.01); *F28F 2240/00* (2013.01); *F28F 2265/26* (2013.01)

(56) References Cited

U.S. PATENT DOCUMENTS

| | | | | |
|---|---|---|---|---|
| 4,090,554 | A * | 5/1978 | Dickinson | F22B 1/066 165/11.1 |
| 7,237,602 | B2 * | 7/2007 | Arai | F28D 1/0461 165/133 |
| 9,688,927 | B2 * | 6/2017 | Chen | C10J 3/86 |
| 2009/0008074 | A1 * | 1/2009 | Vamvakitis | F28D 7/0083 165/177 |
| 2014/0000845 | A1 * | 1/2014 | Vanderwees | F28F 27/00 165/83 |

* cited by examiner

HEAT EXCHANGER FOR CONTAMINATED FLUIDS AND SUBJECTED TO STRONG VARIABLE HEAT LOAD

FIELD OF THE INVENTION

The present invention relates to a heat exchanger for contaminated fluids which are subjected to strong variable heat load.

BRIEF DESCRIPTION OF THE PRIOR ART

Such heat exchanger, of shell and tube type with in-tube gas, is provided with a new structure, optimized for such fluids. As it is known and very briefly, a shell and tube heat exchanger is a surface heat exchanger, mainly made up of a bundle of tubes arranged inside a more or less cylindrical vessel (called shell). Such a device is crossed by two currents: one current passes inside the tubes and the other one passes through the space delimited between the inner surface of the shell and the outer surfaces of the tubes. Among heat exchangers it is the most used model and allows the exchange of great heat quantities, by having exchange surfaces which can reach tens of thousands of square metres.

In one of the possible versions, there end to the shell at least two flanged gates, which are intended for the service fluid (i.e. the cooling/heating fluid used as vector of the heat exchange, generally water) and two heads intended for the process fluid (i.e. the fluid which has to be cooled/heated, which is up directly to the industrial process) to which the bundle of tubes is welded.

In the shell there can be provided transverse sheet plates, called baffle plates, which are intended to control the hydraulic regime in the same shell by increasing crossing speed and as a consequence the heat exchange coefficient.

However, the traditional shell and tube heat exchanger is not optimal in case the gas is contaminated with strong-variable load. Firstly, the tubes of the bundle of tubes, since they are crossed by a "dirty" gas, are subjected to a possible occlusion. Clearly, the occluded tube will transfer less heat than what a corresponding free and well functioning tube will do. Therefore the two tubes will be subjected to different temperatures and to consequent different thermal expansions. As a consequence, this will induce an increased stress condition in the welding zones between tubes and head, which could compromise the useful life of the element. This drawback is yet more serious if it is considered that the working fluid is subjected to sudden heat variations.

SUMMARY OF THE INVENTION

Therefore, there is the need for a new heat exchanger for contaminated gases and which are subjected to strong variable heat load, which overcomes the above described drawbacks.

Object of the invention is a heat exchanger for cooling contaminated gases and subjected to a variable heat load according to what claimed in claim 1.

The independent claims describe details and further advantageous aspects of the invention.

BRIEF DESCRIPTION OF THE DRAWINGS

The different embodiments of the invention are now described by means of the examples, referring to the appended drawings, in which.

DETAILED DESCRIPTION OF THE PREFERRED EMBODIMENTS

Figure 1:
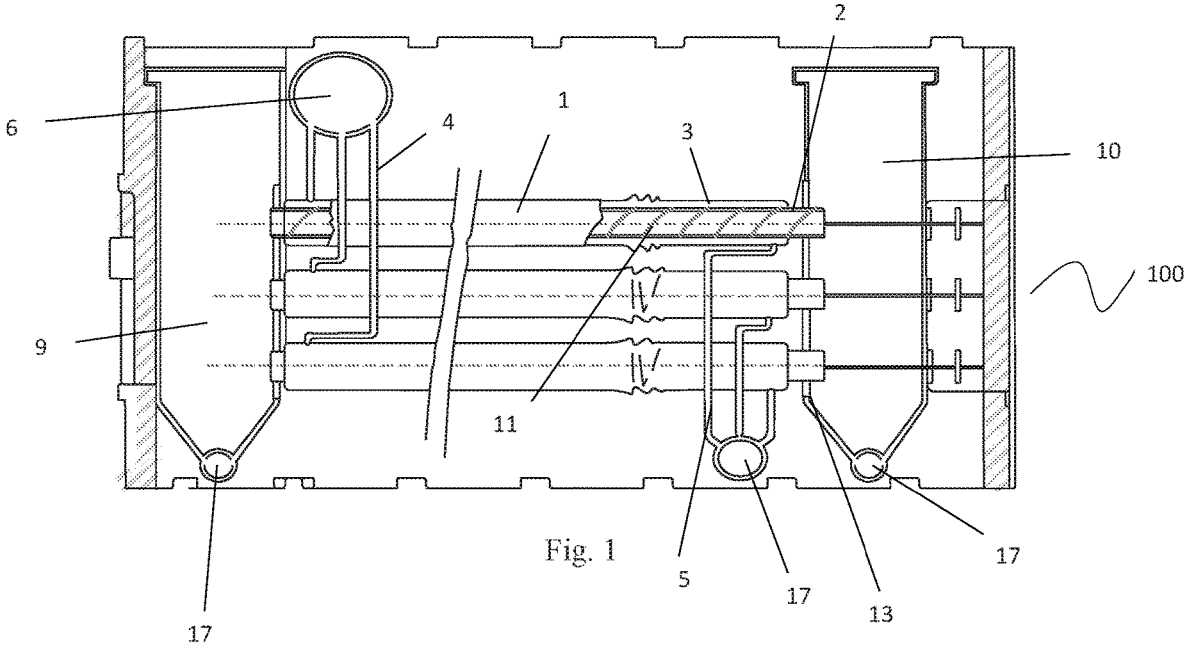
FIG. 1 shows a first embodiment of the heat exchanger according to the present invention, with the bundle of tubes arranged horizontally.
Figure 3:
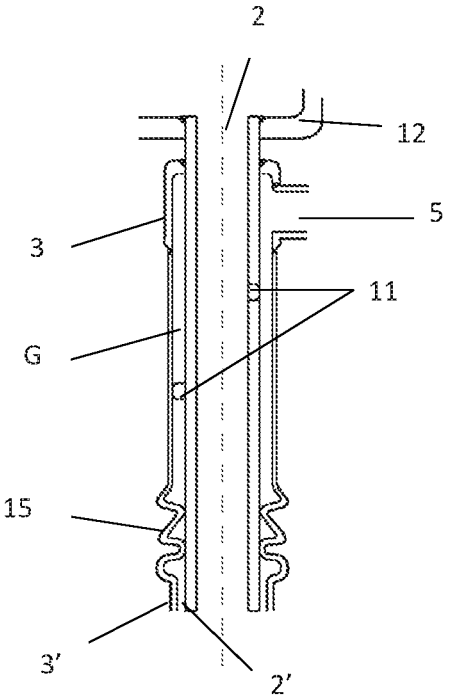
FIG. 3 shows a detail of the lined tube from the gas inlet side according to an embodiment of the present invention.
Figure 4:
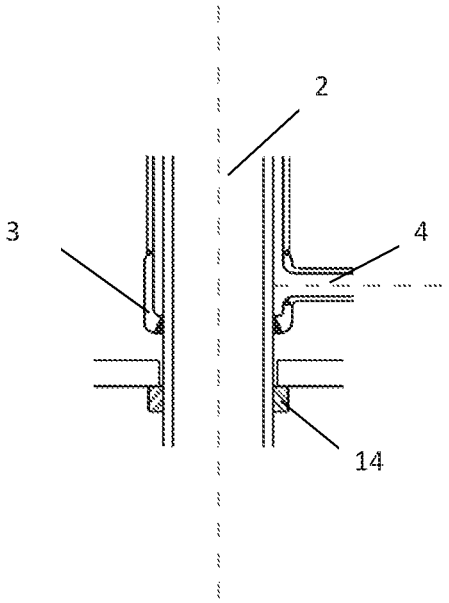
FIG. 4 shows a detail of the lined tube from the gas outlet side according to an embodiment of the present invention.

Referring to FIGS. 1, 3 and 4 the heat exchanger is provided with horizontal axis and comprises a bundle of tubes made up of a plurality of lined independent tubes 1, i.e. with double wall. In particular, the contaminated gas flows inside the inner tube 2, and an outer cooling fluid flows in an annular passage G defined between the outer surface 2' of the inner tube 2 and the inner surface 3' of the outer tube 3. The annular passage G is connected at an end to the intake manifold 6 of the fluid to be heated through independent connection tubes 4, welded on both sides respectively to the feeding manifold 6 and to the bundle of tubes 1, in particular to the outer tube 3.

In the same way, the annular passage G is connected at the opposite end to the outlet manifold 7 of the heated fluid, through independent tubes 5. It is to be observed that the arrangement adopted in FIG. 1, i.e. with the connection tubes 4 which converge to an upper portion of the annular passage G and the connection tubes 5 which go out from a lower portion of the annular passage G, favours the drainage of the annular passage.

The contaminated gas is directed towards the bundle of tubes (inner tubes 2) through a plenum 9, and after crossing the bundle of tubes 1, flows towards an outlet flange from a plenum 10. For example, the inner tubes 2 are connected by welding at the inlet of the tube plate 12.

Figure 2:
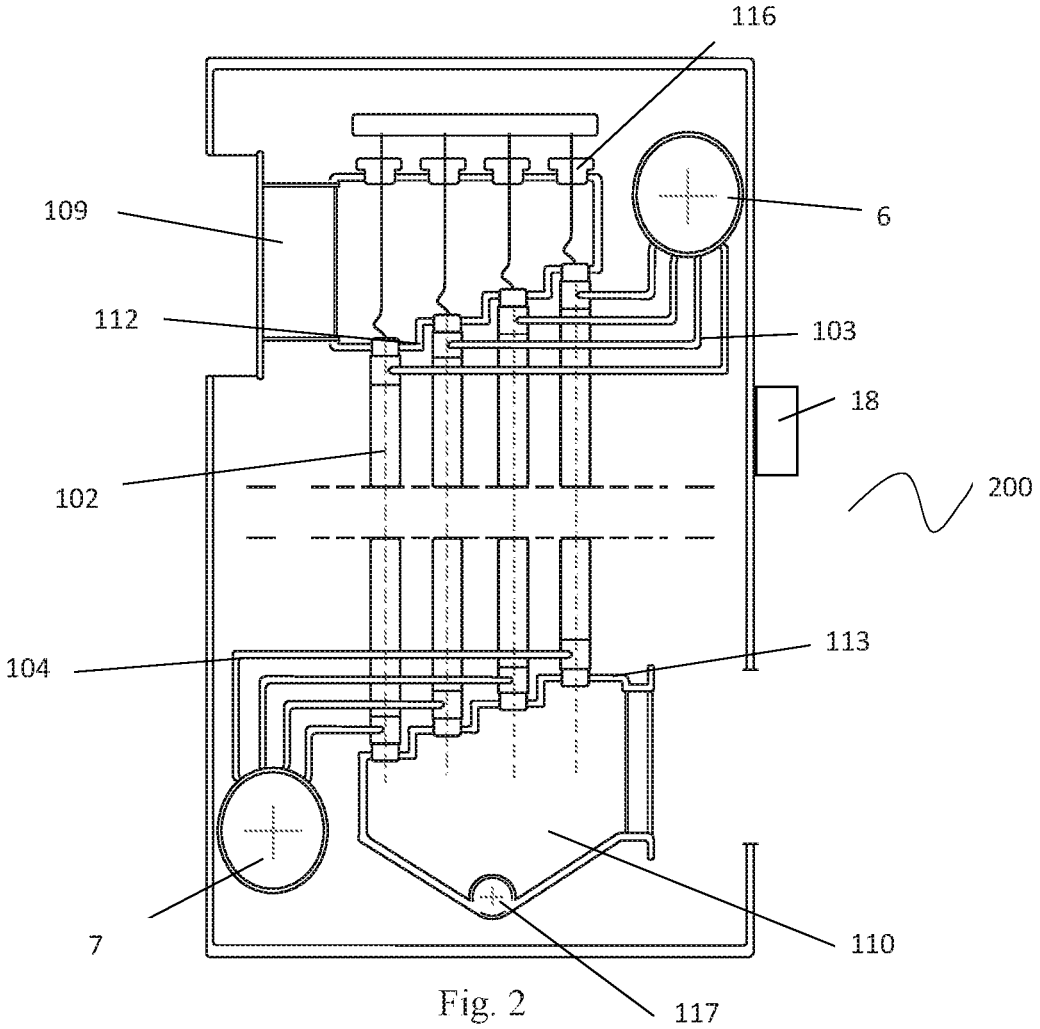
FIG. 2 shows a second embodiment of the heat exchanger according to the present invention, with the bundle of tubes arranged vertically.

At the opposite end, said tubes 2 are guided by the tube plate 13 but are free to expand through the same plate tube, i.e. they are not welded to it. Referring to FIG. 2, the heat exchanger is with vertical axis and comprises a bundle of tubes identical to the one described for the solution of FIG. 1. Also the other elements of the exchanger, plenum 109, 110, tubes 102, 103, 104, 105, annular passage G formed between the outer surface 102' of the inner tube 102, and the inner surface 103' of the outer tube 103, tube plates 112, 113 are nearly identical except for their vertical arrangement. It is to be noted that the arrangement of the connection tubes 4, 104, 5, 105, respectively between feeding manifold 6 and annular passage and between annular passage and outlet manifold 7 is studied avoiding sub-manifolds, i.e. in order to have small flexible and independent ducts. In this way, each duct is free to expand and each duct can be closed mechanically or by welding so that a possible leakage is isolated. Advantageously the plenum 9, 10, 109, 110 are provided with a device 17, 117, for example an Archimedean screw for a rapid ash or other solid materials elimination provided in the contaminated gases.

According to a preferred embodiment of the invention, both the upper and lower tube plates 112, 113 are realized with a "stepped" shape or more generally they are inclined with respect to the axis of the exchanger, so that the plenum 109, 110 are provided with passage sections proportional to the fluid flow rate so that the speed of the gas inside the plenum 109, 110 and as a consequence inside the tubes 112 is almost constant.

Referring to the FIG. 3 it is shown a detail, in transverse section, of a lined tube 1 from the gas inlet side. As it is to be noted, in the middle it is provided the inner tube 2 having an outer diameter between 40 and 100 mm, limited by the outer tube 3 coaxial to the same and welded to both the ends of the tube 2. The interspace between the two tubes makes up the annular passage G. Inside said annular passage G it is provided a wire 11 or other helically wound structural around the tube 2 which has the function to maintain the outer tube 3 at constant distance and as a consequence to maintain a section of the annular passage G constant as well as to increase the fluid speed with equal flow rate. In particular, said annular passage G has a radial dimension preferably between 2 and 4 mm.

The dimensioning of the wire 11 depends on the working fluid used considering the possible evaporation of the fluid during the crossing of the annular passage G and the consequent volumetric flow rate variation.

In the initial portion of the tube 1 independent tubes 5 are introduced which are welded to the bundle of tubes 1 and which make the water or cooling fluid go out from the annular passage G towards the manifold. In particular, there is a tube 5 for each outer tube 3 of the bundle of tubes.

Preferably in the final portion of the tube 1, the outer tube 3 is provided with a corrugated profile 15 able to absorb the thermal expansions of the inner tube 2. It is to be noted that the same corrugated profile is not apt for the inner tube 2 since its cleaning is not eased. Therefore, the adopted reason for the inner tube 2 is that of the end free to be deformed.

Alternatively to the corrugated profile, the outer wall can be realized in two sections, connected to a welded expansion element.

Referring to FIG. 4 it is shown a detail of a lined tube 1 from the gas outlet side. In the initial portion independent connection tubes 4 are introduced by welding to the bundle of tubes. In the final portion of the figure, it is highlighted how the tube plate 13 guides the tube 1 at its free end. Clearly, since there are no welded junctions between the tube and the tube plate, it is needed to use a seal 14.

Said seal 14 can be a suitable gasket, for example a mechanical seal, realized by a metal disk and an elastic push element, or a seal in elastomeric or metal-elastomeric mixed material (lip seal ring). The volume limiting the outer wall of the tubes is obviously in connection with the outer environment (air at atmospheric pressure). If the free end of the tube 1 is not realized as a seal, an air flow is induced by this volume to the outlet plenum 10, if, as usually, is at a pressure slightly lower than the atmospheric one.

Said vertical tubes 102 can be cleaned by any known device, preferably a helical insert which can be guided alternately or rotatingly inside the tube 102 through plugs 116 positioned in the upper portion of the plenum 109. Alternatively, an automatic brush tubular or shotblasting cleaner can be used to maintain clean the inner surface of the tube 102.

The whole bundle of tubes 1, in case of feeding break of the cooling fluid from the manifold 6, as in the case in which the flow remains but the fluid comes back to the exchanger without a suitable cooling, can be cooled by an air flow coming from the outer environment, by means of suitable blowers 18.

Preferably the system should be enclosed in a container, with dimensions and stacking characteristics according to the standards, so that the transport costs are reduced.

Concerning the fluid receiving and transporting heat by crossing the interspace G between the outer tube and the inner one, it can be any heat bringing fluid (diathermal oil, pressured water, molten salt, liquid metal as for example molten Pb, as well as the working fluid of a cycle, for example a Rankine cycle with organic working fluid.

Even if at least an embodiment was described in the brief and detailed description, it is to be intended that there exist many other variants in the protection scope of the invention. Further, it is to be intended that said embodiment or embodiments described are only example and do not limit in any way the protection scope of the invention and its application or configurations. The brief and detailed description give instead the experts in the field a convenient guide to implement at least an embodiment, while it is to be intended that many variations of the function and elements assembly here described can be made without departing from the protection scope of the invention encompassed by the appended claims and/or technical/legal equivalents thereof.

The invention claimed is:

1. A heat exchanger (100, 200) for cooling contaminated fluids which are subjected to a variable thermal load, by means of heat transfer to a receiving liquid and/or vapor fluid, said heat exchanger comprising a tube bundle comprising a plurality of independent tubes (1), two plenums (9, 10, 109, 110), and wherein each of said independent tubes (1) comprise an inner tube (2, 102) in which the contaminated fluids flow, and an outer tube (3, 103) being disposed exterior to said inner tube (2, 102) coaxially and where between an outer surface (2', 102') of the inner tube (2, 102) an inner surface (3', 103') of the outer tube (3, 103) is defined an annular passage (G) in which flows the receiving liquid and/or vapor fluid;

each of the inner tubes (2, 102) are welded to an inlet plate (12, 112) in a gas inlet section, while said each of the inner tubes is guided in a corresponding hole of an outlet plate (13, 113), in a gas outlet section so that said each of the inner tubes (2, 102) expansion in an axial direction is not constrained, wherein each of said annular passages (G) is hydraulically connected to an intake manifold of the receiving liquid and/or vapor fluid, through independent connecting tubes (4, 104), welded on both ends respectively to a feeding collector (6) and a corresponding outer tube (3, 103) of the outer tubes, and said each of annular passages (G) is hydraulically connected to a discharge manifold of the receiving liquid and/or vapor fluid, through second independent connecting tubes (5, 105) welded on both ends respectively to a receiving collector (7) and to a corresponding outer tube (3, 103) of the outer tubes, wherein inside said each of said annular passages (G) has a wire (11), helically wound around said each of the inner tubes (2, 102), having the function of keeping an outer tube (3, 103) of the outer tubes at constant distance from an inner tube (2, 102) of the inner tubes, and accordingly maintaining a constant cross-section of one of the annular passages (G), wherein said inlet and outlet plates (112, 113) are stepwise along an axis of the heat exchanger.

2. The heat exchanger according to claim 1, wherein one of said outer tubes (3, 103) is removable connected at both ends to one of the inner tubes (2, 102).

3. The heat exchanger according to claim 1, wherein said each of the inner tubes (2, 102) have an outer diameter in a range between 40 to 100 mm.

4. The heat exchanger according to claim 1, wherein said each of said annular passages (G) have a radial dimension comprised in a range from 2 to 4 mm.

5. The heat exchanger according to claim 1, wherein each of said outer tubes (3, 103) has a final part which has a corrugated profile (15) able to absorb the thermal expansion of at least one of the inner tubes (2, 102).

6. The heat exchanger according to claim 1, wherein said independent connecting tubes (4) converge in an upper portion of the annular passages (G) and the independent tubes (5) flow out from a lower portion of one of the annular passages (G).

7. The heat exchanger according to claim 1, wherein said first and second independent connecting tubes (4, 104, 5, 105) are independent from each other, so that each of said independent connecting tubes (4) and second independent connecting tubes (5) independently expands; and wherein each of said connecting pipe can be closed mechanically or by welding so that a possible leakage is isolated.

8. The heat exchanger according to claim 1, wherein said plurality of independent tubes (1) are cooled by an air flow coming from the outer environment, by means of blowers (18).

9. The heat exchanger according to claim 1, wherein said annular passages (G) have a flow of organic working fluid of a Rankine cycle.

10. The heat exchanger according to claim 1, wherein said outer tubes (3, 103) and the outlet plate (13, 113) is not connected by welded junctions between each other, but are connected using a seal (14).

11. The heat exchanger according to claim 1, wherein each of the two plenums (9, 10, 109, 110) comprises a device (17, 117) for eliminating solid materials deposited by the contaminated fluids wherein the device is an Archimedean screw.

* * * * *